United States Patent [19]

Bochmann et al.

[11] Patent Number: 4,962,893

[45] Date of Patent: Oct. 16, 1990

[54] PROCESS AND DEVICE FOR COLD MILLING

[75] Inventors: Klaus Bochmann, Wiesbaden; Hans-Joachim Risto, Ludwigshafen; Wolfgang Volker, Tonisvorst; Helmut Gursky, Frankfurt; Dieter Steidl, Hofheim, all of Fed. Rep. of Germany

[73] Assignee: Messer. Griesheim, Fed. Rep. of Germany

[21] Appl. No.: 415,884

[22] Filed: Oct. 2, 1989

[30] Foreign Application Priority Data

Oct. 5, 1988 [DE] Fed. Rep. of Germany ..... 3833830

[51] Int. Cl.[5] ..... B02C 19/06

[52] U.S. Cl. ..... 241/5; 241/23; 241/24; 241/39; 241/65; 241/80; 241/DIG. 37

[58] Field of Search ..... 241/5, 39, 40, 63, 65, 241/66, 67, DIG. 37, 24, 80

[56] References Cited

U.S. PATENT DOCUMENTS 3,186,648 6/1965 Mandle et al. ..... 241/39 X 4,273,294 6/1981 Hollely et al. ..... 241/DIG. 37 X 4,579,288 4/1986 McDermid et al. ..... 241/39

FOREIGN PATENT DOCUMENTS 2133019 1/1973 Fed. Rep. of Germany ..... 241/39

*Primary Examiner*—Mark Rosenbaum

*Attorney, Agent, or Firm*—Connolly & Hutz

[57] ABSTRACT

Fluidized-bed counter-jet mills are gas-jet mills with which extremely fine milling results can be produced with very little wear and tear. An improvement in the milling results can be achieved by cooling the gas jets with a refrigerant, but the improvement that can be achieved is not substantial and the consumption of refrigerant is very high. In order to lower the consumption of refrigerant while considerably improving the fineness of the milled material, the coarse material which is separated by the grader of the mill is cooled by the refrigerant within the fluidized-bed counter-jet mill and fed back into the milling chamber. Liquid nitrogen is the preferred refrigerant with which the sump of the mill is cooled.

10 Claims, 2 Drawing Sheets

PROCESS AND DEVICE FOR COLD MILLING

BACKGROUND OF INVENTION

The invention relates to a process and a device for cold milling in a fluidized-bed counter-jet mill.

Jet mills are pulverizing machines which have been known for a long time and in which the particles to be milled are accelerated by gas flows and pulverized by collision. There are a number of different types of jet mill designs. They differ in the technique of the gas flow, in the way that the particles collide against each other or against a collision surface, and with respect to whether the particles to be milled are carried along in the gas flow or whether the gas flow strikes the particles and sweeps them along. Air or hot steam are generally used as the milling gas.

In the case of the fluidized-bed counter-jet mill, freely expanding jets of gas meet each other in a milling chamber containing the material to be milled in the form of a fluidized-bed. Here, the milling occurs practically exclusively as the result of the collision of the particles of material against each other; hence, the milling process is virtually wear-free. The fluidized-bed counter-jet mill has a grader in which the finely milled material is separated from larger particles that have not yet been sufficiently pulverized. The large pieces are returned to the milling chamber.

Many substances, for example, plastic, are difficult or impossible to mill to a fine grain size because of their toughness. However, when such tough materials are exposed to cold, they become brittle, which improves their milling properties. Therefore, the propellant gas is cooled when jet mills are used; this is described, for example, in West German laid-open application No. 2,133,019. Cooling the propellant gas flow makes it possible to mill materials that could not be milled under normal conditions in jet mills. However, in spite of intensive cooling, for example, with liquid nitrogen, and in spite of the self-cooling effect of the propellant gas flow as a result of its expansion, the attainable improvement of the milling properties leaves a great deal to be desired. Although fine grain sizes can be achieved, this is only possible at an excessively high consumption of time and energy.

SUMMARY OF INVENTION

The invention is based on the object of creating a process and a device for cold milling which involve a low demand for energy and for refrigerant and which, at the same time, make it possible to mill products to even finner grain sizes that had been attainable so far while greatly increasing the throughput volume.

The invention is based on the concept of using a cryogenic refrigerant to cool the circulating material to be milled, instead of cooling the flow of propellant gas. The measure according to the invention produces a marked improvement in the milling results, as can be seen from the operating results presented below.

It is surprising that this can be achieved solely by the measure according to the invention, that is, by cooling the circulating material to be milled instead of by cooling the flow of propellant gas. The inventors deduced this from operating tests with a fluidized-bed counter-jet mill in which, in spite of intensive cooling of the flow of propellant gas with liquid nitrogen, the circulating material to be milled was only slightly cooled in the sump of the mill. The inventors concluded from this that, in order to improve the milling performance, the cooling would have to be directed at the material to be milled itself.

Subsequent theoretical deliverations confirmed the correctness of this conclusion.

It is essential here that when milling is carried out with a cooled flow of propellant gas, the impact energy of a particle which is transformed into heat is only partially transmitted to the cold gas flow. There are several reasons for this. Thus, for example, the time for the heat transfer from the particle to the gas is extremely brief. Since the heat capacity gets smaller as the temperature falls, the temperature increase stemming from impact is greater at low temperatures than at higher temperatures. The relative movement between the particles and the cold propellant gas is slight, so that the values for the heat transfer also drop. Moreover, the thermal conductivity of many materials to be milled is already intrinsically low and becomes even worse as the temperature falls. Moreover, the acceleration energy of cold gas is worse than that of hot gas. The finer the desired grain size is, the worse the milling conditions become when a cooled flow of propellant gas is used for the milling. This is especially true of thermoplastics, which have a very low crystallization range. Milling them in this manner becomes totally uneconomical.

With the invention, a considerable increase in the through-put volume can be achieved on fluidized-bed counter-jet mills. Extremely fine particles with suitable surface augmentation and smooth surface structure can be produced The final product is very pourable and has high bulk density and compacted density. The process according to the invention is especially well-suited for milling materials that are tough, rubbery, sticky or greasy. These include primarily natural substances, many pharmaceutical products, thermoplastics, different types of wax and high-molecular plastics. Mainly liquefied gases, especially nitrogen, can be used as refrigerants, although carbon dioxide is also an option. The simplest and, in many cases, most efficient technique is to feed these gases directly into the sump of the mill. Of course, it is also possible to indirectly cool the material to be milled. Indirect cooling can also be achieved by means of other refrigerants, for example, brine baths.

THE DRAWINGS

DETAILED DESCRIPTION

In the description below, the same reference numbers have been used for the same parts in all of the figures.

Figure 1:
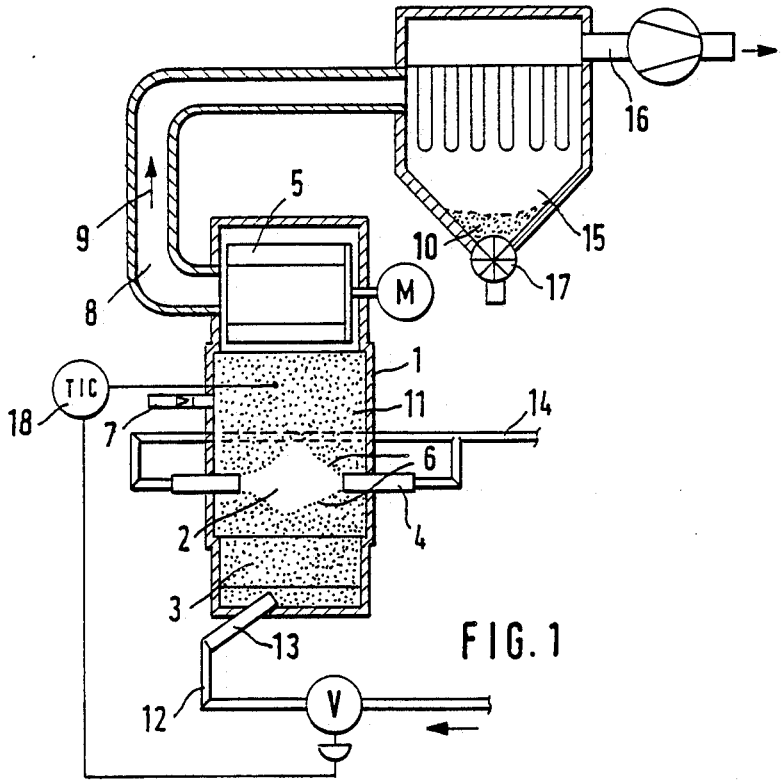
FIG. 1 illustrates a fluidized-bed counter-jet mill in schematic form.

FIG. 1 shows a fluidized-bed counter-jet mill in schematic form. The mill consists of a housing 1, which comprises the milling chamber 2 and the sump 3. The propellant gas enters the milling chamber 2 and the sump 3. The propellant gas enters the milling chamber 2 via the nozzles 4. The grader 5 is adjacent to the housing 1. The material to be milled is in the milling chamber in the form of a fluidized-bed 6. The material to be milled is fed in via lock 7. The fine material 10 separated in the grader 5 is sucked off through the fine material outlet 8 as shown by the arrow 9, and it is carried to the filter system 15. This system has a connection piece 16 for the exhaust gas and a removal lock 17 for the resultant finely milled material 10. The coarse material 11 flows from the grader 5 back into the milling chamber 2. The propellant gas which enters via the nozzles 4 is fed into the system via the feed line 14.

According to the invention, the material to be milled, which is in the sump 3 of the mill, is cooled off by liquid nitrogen. The liquid nitrogen is fed in via the line 12 and the porous feed element 13. Porous feed elements are especially well-suited for small mills. For mills with larger diameters, other feed systems, for example, nozzle plates, are preferable so as to be able to feed in the nitrogen as finely dispersed as possible. Nitrogen is fed via the line 12 and the porous feed element 13 as a function of the temperature control mechanism 18. The material can also be fed directly into the sump 3 via lock 7. The fine fraction of the fine material 10 is determined by the speed of the grader. The coarse material 11 flowing back from the grader 5 forms the fluidized-bed 6, together with the material to be milled that comes from lock 7. The liquid nitrogen entering via the porous feed element 13 evaporates and cools the sump of the mill, i.e. it cools the coarse material 11 flowing back from the grader 5 as well as any material to be milled that might have been newly added while the coarse material is thus in the disperse phase. The evaporated cold nitrogen moves upwards through the material and enters the milling zone. Cold gas, coarse material and milled material form a first fluidized-bed zone below the milling chamber 2 in the sump 3.

Figure 2:
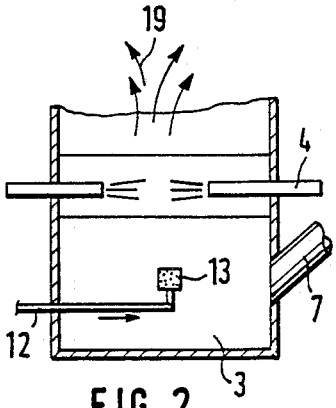
FIG. 2 illustrates the cooling of the sump of the fluidized-bed counter-jet mill of FIG. 1.

FIG. 2 schematically shows the lower part of the fluidized-bed counter-jet mill like in FIG. 1, but with the difference that the lock 7 for the material to be milled is located directly at the sump 3. The arrow 19 indicates the mixture of cold gas, propellant gas, coarse material and milled material, as this mixture moves upwards towards the grader.

Figure 3:
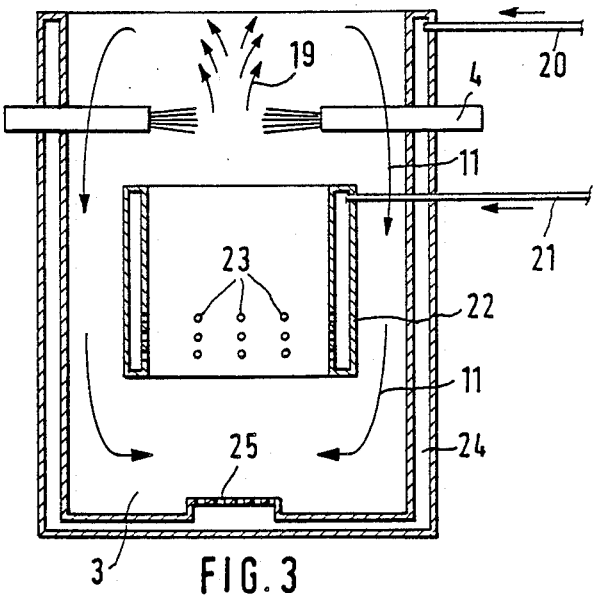
FIG. 3 illustrates a mixed form consisting of direct and indirect cooling of the sump.

FIG. 3 shows a variant with indirect and direct heat exchange between the added nitrogen and the material to be milled. The liquid nitrogen is fed in via lines 20 and 21. The liquid nitrogen entering via the line 21 reaches a double-walled pipe 22 closed on its front surfaces This double-walled pipe 22 has outlet openings 23 facing towards the inside. The entire lower part of the mill housing is likewise designed as a double-walled chamber 24. Line 20 opens into this chamber. The chamber 24 has outlet openings 25 in the sump 3 for the nitrogen entering via the line 20. Therefore, the coarse material 11 flowing back from the grader is first indirectly cooled in the area between the double-walled pipe 22 and the chamber 24. Subsequently, direct cooling takes place by the nitrogen coming out of the outlet openings 23 and 25. Depending on the mode of operation, this nitrogen can still be liquid or already in the gaseous state.

Figure 4:
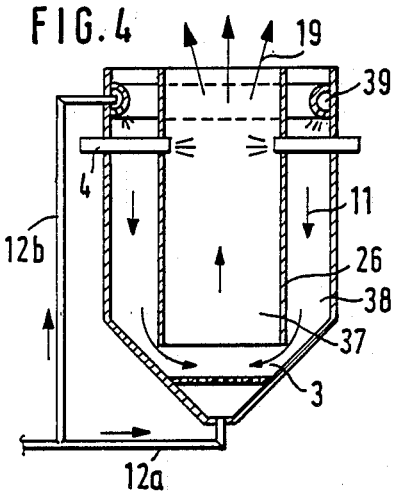
FIG. 4 illustrates an embodiment similar to FIG. 3, but exclusively with direct cooling.

FIG. 4 shows an embodiment similar to FIG. 2, but with an elongated sump 3. By means of a tubular apron 26, the coarse material 11 and the cold gas are forced into a certain flow pattern. The apron 26 separates the milling chamber into a central shaft 37, where the milling process takes place, and into an annular shaft 38 for the coarse material flowing back. The liquid nitrogen is fed in at two places, namely, via line **12*a* directly into the sump 3 and via line 12*b* into a spray system 39 in the annular shaft 38. The nitrogen fed in via line 12*b*** then directly cools the coarse material flowing back from the grader.

The invention is not limited to the above-described embodiments, since there are numerous other possibilities to use a refrigerant to cool off the coarse material flowing back from the grader. It is also possible to join together several milling zones having sumps one after the other in the form of a cascade. In this case, the mixture of fine material and coarse material emerging from the milling zone is separated from the exhaust gas in a filter and carried to the next milling zone. The sump located beneath every milling zone is cooled according to the invention. Only the last stage is equipped with a grader.

The following operating results show the improvement achieved by the process according to the invention in comparison to the prior-art mode of operation.

| Product designation | Grain sizes Material fed in $d_{10}$ µm | $d_{50}$ µm | $d_{90}$ µm | Final product $d_{10}$ µm | $d_{50}$ µm | $d_{90}$ µm | Product throughput kg/h | Gas throughput Air $m^3/h$ | $N_2$ $m^3/h$ |
|---|---|---|---|---|---|---|---|---|---|
| Hostalen ® GUR 200 | 30.3 | 82.2 | 127.3 | 17.5 | 32.1 | 85.3 | 2.0 | 850 | without |
| Hostalen ® GUR 200 | 30.3 | 82.2 | 127.3 | 14.3 | 23.6 | 38.6 | 13.0 | 850 | 200 |
| Polyamide | 70 | 130 | 200 | | | | no milling effect | 850 | without |
| Polyamide | 70 | 130 | 200 | 10.2 | 26.5 | 41.6 | 3 | 850 | 300 |

Hostalen ® GUR 200 is a high-molecular polyethylene made by the Hoechst AG company in Frankfurt, West Germany. As the operating results show, it was not possible to mill the two materials studied to a level of fineness comparable to the fineness that can be achieved by means of the process according to the invention.

Analysis of the grain size was carried out by means of a commercially available laser granulometer (Cilas). The $d_{10}$, $d_{50}$ and $d_{90}$ values were selected as representative values. For example, the $d_{10}$ value of 10.2 µm in line 4 of the table means that 10% of the final product comprised grains with a size of less than 10.2 µm.

An especially surprising aspect is the increase in the product throughput volume with Hostalen ® GUR 200 from 2.0 to 13.0 kg/h characterized at the same time by a considerably narrower grain-size range. Due to the resultant significant increase in the specific surface, new application possibilities become feasible.

What is claimed is:

1. In a process for cold milling in a fluidized-bed counter-jet mill including exposing a milling chamber to gas jets, feeding the material to be milled to the chamber, separating the coarse material from the fine material in a grader, and providing a sump beneath the milling chamber for added material to be milled as well as for coarse material coming back from the grader, the improvement being in that cooling the coarse material coming back from the grader by a cryogenic refrigerant within the fluidized-bed counter-jet mill while the coarse material is in its disperse phase.

2. Process according to claim 1, characterized in that disposing the cryogenic refrigerant in a finely distributed form into contact with the coarse material.

3. Process according to claim 2, characterized in that conveying the cryogenic refrigerant into the sump.

4. Process according to claim 1, characterized in that conveying the cryogenic refrigerant into the sump.

5. In a device for cold milling in a fluidized-bed counter-jet mill having a milling chamber exposed to gas jets, feeding means for feeding the material to be milled, a grader for separating the coarse material from the fine material, a sump beneath said milling chamber for added material to be milled as well as for coarse material coming back from said grader, the improvement being in a cryogenic refrigerant feed means within said mill for cooling the coarse material coming back from said grader, said means for the cryogenic refrigerant being located in said sump of said fluidized-bed counter-jet mill and being designed as a closed double-walled pipe on the front surfaces; and said pipe being positioned in the axial direction at a distance from the cylindrical walls of said milling chamber and having outlet openings facing towards the axis of said pipe for the refrigerant.

6. Device according to claim 5, characterized in that the walls of said milling chamber facing double-walled pipe being designed as double walls which can be filled with cryogenic refrigerant and which have outlet openings facing towards said sump for the refrigerant.

7. In a device for cold milling in a fluidized-bed counter-jet mill having a milling chamber exposed to gas jets, feeding means for feeding the material to be milled, a grader for separating the coarse material from the fine material, a sump beneath said milling chamber for added material to be milled as well as for coarse material coming back from said grader, and a concentric tubular apron separating said milling chamber into a central shaft and into an annular shaft, and cryogenic refrigerant feeding means for feed cryogenic refrigerant into said chamber.

8. Device according to claim 7, characterized by a spray system for the cryogenic refrigerant in said annular shaft.

9. Device according to claim 7, characterized by said feed means directing the cryogenic refrigerant in a direction toward the axis of said chamber.

10. Device according to claim 7, characterized by said cryogenic refrigerant being liquid nitrogen.

* * * * *